United States Patent [19]

Mizutani et al.

[11] 4,019,351

[45] Apr. 26, 1977

[54] APPARATUS FOR FLUID TREATMENT OF A FIBER PRODUCT

[75] Inventors: Hiroshi Mizutani, Nagashimacho; Hitoshi Ono, Moriyama, both of Japan

[73] Assignees: Nihon Senshoku Kikai Kabushiki Kaisha; Takeni Senka Kabushiki Kaisha, both of Japan

[22] Filed: Aug. 27, 1975

[21] Appl. No.: 608,407

[30] Foreign Application Priority Data

Sept. 9, 1974 Japan ..... 49-102947

[52] U.S. Cl. ..... 68/177; 68/184

[51] Int. Cl.[2] ..... D06B 3/28

[58] Field of Search ..... 68/177, 178, 184

[56] References Cited

UNITED STATES PATENTS

| | | | |
|---|---|---|---|
| 3,497,311 | 2/1970 | Masuda | 68/177 X |
| 3,599,447 | 8/1971 | Arashi | 68/177 |
| 3,659,438 | 5/1972 | Chiba et al. | 68/177 |
| 3,679,357 | 7/9172 | Christ et al. | 68/177 X |
| 3,911,702 | 10/1975 | Eckrodt | 68/177 |

*Primary Examiner*—Philip R. Coe
*Attorney, Agent, or Firm*—Wenderoth, Lind & Ponack

[57] ABSTRACT

An apparatus for fluid treatment of a fiber product is provided in which an endless fiber product is circulated in a predetermined direction within a treatment bath in a treatment vessel, characterized in that said apparatus comprises a fiber product residence section composed of a horizontal outer tube communicating with the side of the lower portion of said treatment vessel and a perforated tube concentrically provided inside said outer tube, a high-speed revolving reel for running said fiber product provided outside said treatment bath in said treatment vessel and a tube for transferring said fiber product provided with a treatment fluid jet nozzle for high-speed transfer of said fiber product so provided outside said treatment vessel as to connect the rear portion of said reel in said treatment vessel to the tip of said horizontal outer tube.

1 Claim, 5 Drawing Figures

APPARATUS FOR FLUID TREATMENT OF A FIBER PRODUCT

BACKGROUND OF THE INVENTION

The present invention relates to an improvement in an apparatus for fluid treatment of a fiber product in which a fabric such as woven fabric and knitted fabric connected in an endless state is continuously circulated and revolved in a treatment liquor in the performance of a treatment such as dyeing and scouring.

As an apparatus for fluid treatment of a fiber product of this kind, we previously proposed such an apparatus as shown in U.S. Pat. No. 3,659,438, wherein the lower half of a treatment vessel per se is formed into a residence section for a fiber product, above a treatment bath inside said treatment vessel, a revolving reel for running the fiber product is provided, at the same time, at the rear portion of said reel, a fiber product transfer tube provided with a treatment fluid jet nozzle for high-speed transfer of the fiber product is provided in the upper part inside said treatment vessel, the end of said fiber product transfer tube being connected to said residence section.

In said apparatus, the fiber product is transferred by flow while floating in the residence section; said residence section is required to have considerable room, i.e. capacity to facilitate transfer of the fiber product. Because the fiber product floats for a long period of time, a part of said fiber product exposed to a gaseous phase portion does not contact the treatment fluid, which results in uneven dyeing. In addition, because the fiber product transfer tube and the jet section are accommodated inside the treatment vessel, there are many unnecessary gaseous phase portions, requiring fruitless energy. And in said conventional apparatus, when it is attempted to raise the circulation speed of the fiber product, the treatment liquid jetting speed in the jet section must be raised. On the other hand, because the residence for the fiber product is not blocked by the fiber product, but has sufficient room, eddy and turbulent flows are brought about in said residence section by the liquid stream jetted at a high speed from said transfer tube and the fiber product is not transferred in an orderly arrangement i.e. in front and rear directions and when the fiber product is pulled up by said reel, the fiber product binds and circulation and revolution of the fiber product at times becomes impossible.

The present invention has an objective, the elimination of such drawbacks, making possible high-speed driving at a small bath ratio, shortening the treatment time and saving energy.

DETAILED DESCRIPTION OF THE INVENTION

Figure 1:
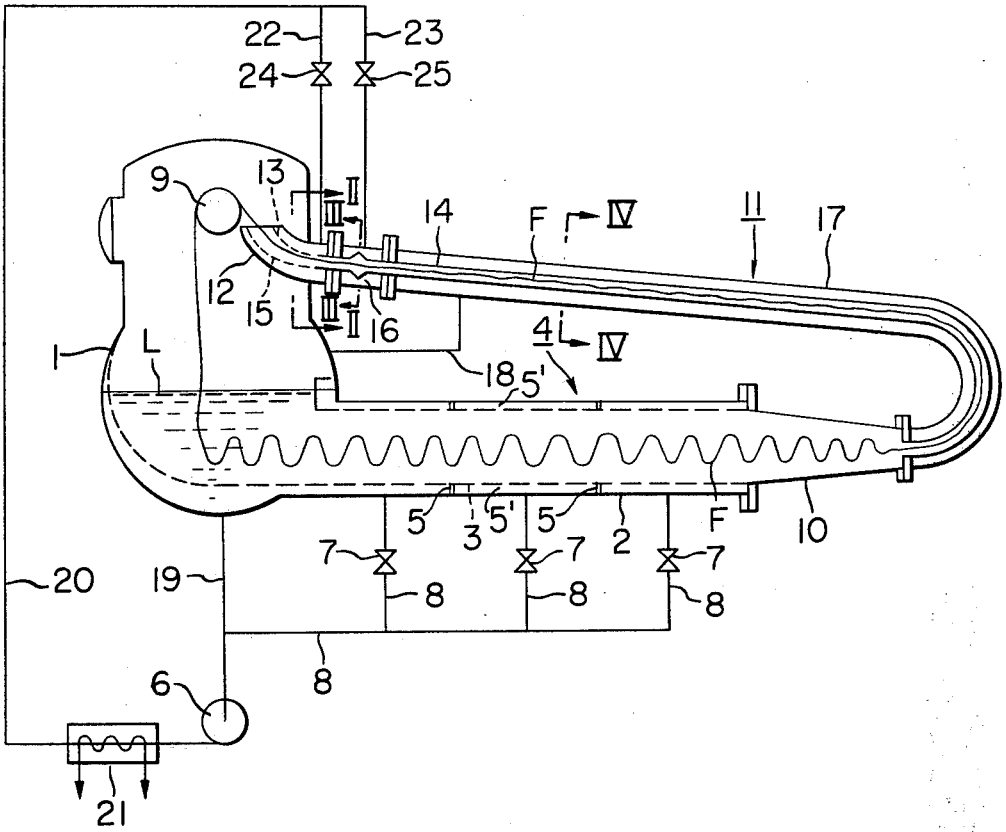
FIG. 1 is a side elevation in longitudinal section illustrating one embodiment of an apparatus for fluid treatment of a fiber product according to the present invention applied to a dyeing machine.

The present invention relates to an apparatus for fluid treatment in which an endless fiber product is circulated in a predetermined direction within a treatment bath in a treatment vessel, characterized in that said apparatus comprises a fiber product residence section composed of a horizontal outer tube communicated with the side of the lower portion of said treatment vessel and a perforated tube concentrically provided inside said outer tube, a high-speed revolving reel for running said fiber product provided outside said treatment bath in said treatment vessel and a tube for transferring said fiber product provided with a treatment fluid jet nozzle for high-speed transfer of said fiber product so provided outside said treatment vessel as to connect the rear portion of said reel in said treatment vessel to the tip end of said horizontal outer tube.

In an apparatus for fluid treatment of a fiber product according to the present invention, as mentioned above, the fiber product residence section is horizontally provided at the side of the lower portion of said treatment vessel without being provided inside said treatment vessel; the entrance of said residence section and the rear portion of the high-speed revolving reel provided at the desired height above the level of the treatment bath in said treatment vessel are connected by the fiber product transfer tube provided with the treatment liquor jet nozzle for high-speed transfer of the fiber product; said jet nozzle and said transfer tube are provided outside the treatment vessel, therefore, an unnecessary gaseous phase portion disappears in said residence section; the fiber product is always immersed in the treatment fluid, not being dyed unevenly; useless energy is not consumed in circulating and revolving the fiber product and it becomes possible to drive the apparatus at a high speed by increasing the jet speed of said jet nozzle.

Also, in the present invention, because said residence section comprises double tubes composed of the horizontal outer tube communicating with the side of the lower end of the treatment vessel and the perforated tube concentrically provided inside said outer tube, by making said perforated tube cylindrical and having a small cross section to the extent where the sequence of transfer of the fiber product does not fall into disorder even if the jetting speed of said jet nozzle is increased to densely transfer a fabric into the perforated tube without space; a greater part of a treatment fluid jetted at a high speed from said fiber product transfer tube to said residence section does not pass through the perforated tube due to existence of the fiber product blocking said perforated tube, but flows out into the horizontal outer tube from said tube and circulates through the space between the outer tube and the perforated tube. Accordingly, a greater part of the treatment fluid neither brings about turbulence of the liquid flow nor invites disorderly motion of the fiber product inside said residence section. As such, according to the present invention, because the fiber product is treated while it is regularly transferred forwardly inside the residence section having a small cross section, by the dynamic pressure of a jet flow from said transfer tube and the flow of a part of the treatment fluid inside the residence section, it is possible to reduce the treatment bath ratio, and at the same time, as mentioned above, even when the jet speed of the treatment liquor in the jet nozzle is raised, no turbulent flow is brought about in the residence section, therefore, high speed driving of the apparatus becomes possible.

As such, according to the apparatus of the present invention, because the bath ratio is small, it is possible to reduce the liquid volume of the treatment fluid as well as the time for raising and lowering the temperature of the treatment fluid and for excluding the treatment fluid. Therefore, when this apparatus is applied to a dyeing machine, the dyeing cycle is shortened, the bath ratio is small and the liquid volume of the treatment fluid can be reduced as mentioned above, the dyeing bath concentration becomes high, the concentration gradient of the fiber product to be dyed and the dyeing bath increases, the dyeing speed becomes large, the dyeing period can be shortened, at the same time, the of the excluded liquor becomes concentrated the same as said dyeing bath concentration, therefore, the draining treatment is simplified.

Again, according to the present invention, because the circulation and transfer speed of the fiber product is made high as mentioned above, the opportunity for the fiber product to contact the dye increases, the dyeing speed is raised. At the same time, from the initial stage, to the fiber product to be dyed, the dye liquor is uniformly imparted and the dyeing period is shortened. Further, as mentioned above, the circulation and transfer speed of the fiber product is made high, as a consequence of which, upon treating the fiber product in a rope form, the transfer speed of rope creases becomes large and the rope creases are unlikely to occur in the treated fiber product.

The present invention also relates to an apparatus for fluid treatment of a fiber product which comprises the aforesaid apparatus for fluid treatment of a fiber product, further characterized in that the annular space formed between said horizontal outer tube and said perforated tube is divided into the required number of divided annular spaces in an axial direction via partitions provided inside said space and each of said divided annular spaces and a pump for circulating the treatment fluid are connected by a bypath (bypass) circuit interposed with an opening and closing valve, respectively. In case transfer ahead of the fiber product in said fiber product residence section is too fast or too slow, depending upon the amount and kind of each charge of the fiber product, said opening and closing valve of said bypath (bypass) circuit connecting each of said divided chambers, divided by the partitions in the space between said perforated tube and said outer tube and said pump for circulating the treatment fluid, is adjusted by opening and closing so as to vary the residence position of the fiber product in the residence section to thereby transfer ahead the fiber product in said residence section regularly and smoothly, by which said apparatus is operable without hindrance from a treatment fluid at a high speed having a high flux.

Hereinafter, the present invention will be explained by reference to the illustrated embodiment applying the present invention to a dyeing machine.

Reference numeral (1) designates a dyeing vessel constituting said treatment vessel, with the side of the lower end of which a horizontal outer tube (2) is communicated. Inside said outer tube, a cylindrical perforated tube (3) is provided concentrically, and a residence section (4) for a fiber product, for example, a fabric is constituted by said outer tube (2) and said perforated tube (3). In the annular space formed between said outer tube (2) and said perforated tube (3) in said residence section (4), a desired number of annular chambers (5′) are provided at predetermined positions in an axial direction as a result of said annular space being divided by partition rings (5), mined positions in an axial direction, by partition rings (5), said space being divided into a desired number of annular chambers, and a pump (6) for circulating a dye liquor as a treatment fluid, a bypath (bypass) circuit (8) in which an opening and closing valve (7) is interposed, respectively, is provided.

Above, a dye liquor (L) inside said dyeing vessel (1), a high-speed revolving reel (9) for running the fabric is provided. The rear portion of said reel (9) inside said dyeing vessel (1) and a conduit (10) connected to the tip of said perforated tube (3) at the end of said residence section (4) are connected by a fabric transfer tube (11).

In FIG. 1, reference numeral (12) designates a shower section provided directly at the rear of said reel (9) and connected to said transfer tube (11). Inside said section (12), a fabric inlet (13) whose cross section is flared to be penetrated with an endless fabric (F) is provided. The inner wall of said fabric inlet (13) is perforated, jetting the dye liquor to the fabric (F) regardless of the direction of travel, and thereby impregnating said fabric with the dye liquor.

Reference numeral (16) designates a jet nozzle for high-speed transfer of the fabric provided in said conduit (14) adjacent to said shower section (12) adapted to jet the dye liquor at a high speed to the fabric in the direction of its travel.

Figure 2:
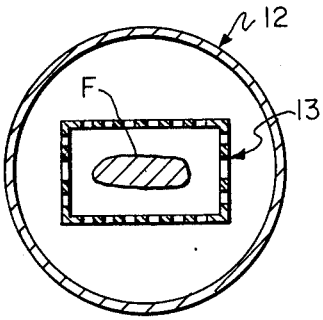
FIG. 2, FIG. 3 and FIG. 4 are sections taken along the arrows II—II, III—III and IV—IV of FIG. 1.
Figure 3:
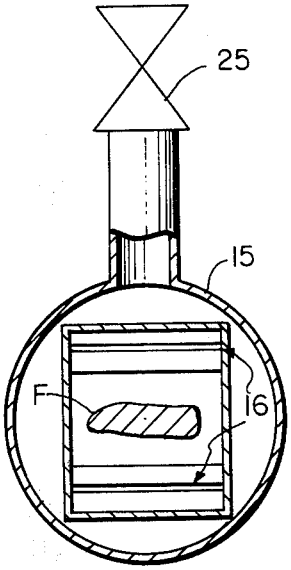
Figure 4:
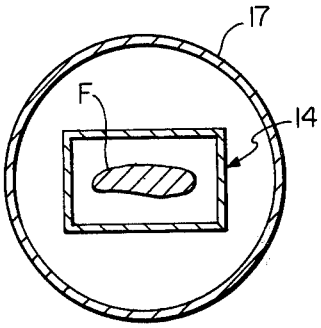
Figure 5:
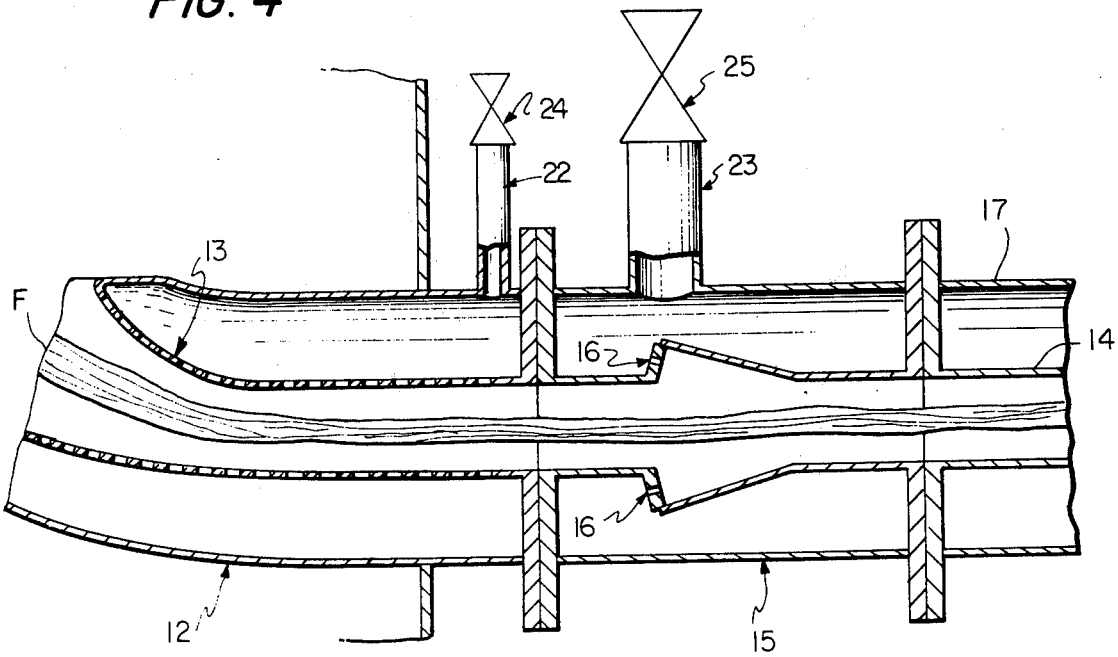
FIG. 5 is a detailed side view of a jet nozzle in FIG. 1.

Said transfer tube (11) comprises double tubes, the conduit (14) constituting the inner tube thereof is, as shown in FIG. 2 and FIG. 3, constituted to have a square section including the fabric inlet (13) to prevent torsion of the fabric circulating and revolving through penetrating the conduit (14), the tip of said conduit (14) communicates with conduit (10). In order that the fabric transfer tube (11) may resist a sufficiently high pressure, on the outer periphery of said conduit (14), a cylindrical tube (17) is concentrically provided, said cylindrical tube (17) and said dyeing vessel (1) are connected by a communicating tube (18) so as to equalize the internal pressure of the two, (17) and (1).

In FIG. 1, reference numeral (19) designates a dye liquor conduit connecting the bottom of the dyeing vessel (1) and the inlet of said pump (6), reference numeral (20) designates a dye liquor conduit connected to the outlet of said pump (6), and reference numeral (21) designates a heat exchanger. The dye disposed in these conduits and heat-exchanger is forwarded to said shower section (12) and said jet nozzle (16) via branch tubes (22), (23), respectively. Reference numerals (24), (25) designate opening and closing flow rate regulating valves interposed in each of said branch tubes 22, 23.

The illustrated apparatus being constituted as mentioned above, the endless fabric (F) pulled up from the dye liquor (L) of said dyeing vessel 1 by said reel 9 and is forwarded to the conduit 14 of said fabric transfer tube 11. In said shower section 12, said fabric F is liquid sealed with the dye liquor forwarded via the branch tube 22. In said jet nozzle 16; the dye liquor forwarded via the branch tube 23 is jetted to the fabric F, which in turn is forwarded at a high speed inside the conduit 14 and forwarded to the perforated tube 3 of the fabric residence section 4 via the conduit 10.

Because said fabric F is densely filled in the perforated tube 3 and there is no room between the fabric F and the perforated tube 3, a greater part of the dye liquor jetted from the tip exit of the conduit 14 of said transfer tube 11 is separated from the fabric F, through the perforation tube 3, advancing through the space between said perforated tube 3 and said outer tube 2 without causing turbulent flows in the fabric residence section 4, the fabric F is transferred forwardly in good order by the dynamic pressure of the jet flow and the flow of a part of the dye liquor inside the fabric residence section 4, and thus the fabric F is circulated and revolved smoothly at a high speed.

On the other hand, the dye liquor advancing through the space between said perforated tube 3 and said horizontal cylinder 2 is sucked by the pump 6, discharged from the conduit 20, heat-exchanged by heat-exchanger 21, controlled to a proper flux by the opening and closing (flow rate regulating) valves 24, 25 via the branch tubes 22, 23 and jetted from the shower section 12 and the jet nozzle 16 to be circulated.

Depending upon the amount and kind of fabric F, there are cases in which the fabric F is pressed against the front of the fabric residence section 4 or the fabric stagnates at the entrance of said section 4 and cannot be smoothly transferred forwardly and upon withdrawing the fabric F by said reel, there are cases in which the fabric is burdened by tension or the fabric is entangled. In the case of the former, the opening and closing (flow rate regulating) valve 7 is opened to withdraw the dye liquor from the divided spaces between said perforated tube 3 and said horizontal outer tube 2 to thereby reduce the liquid pressure on the front of the fabric residence section. In consequence the condition of the withdrawn fabric F is improved. In the case of the latter, i.e. fabric stagnation, said opening and closing (flow rate regulating) valve 7 causes the liquid flow to move forward together with the fabric F in the fabric residence section 4 to eliminate stagnation of the fabric F at the entrance of said fabric residence section 4.

And corresponding to the transfer state of the fabric F in the fabric residence section 4, the bypath (bypass) circuit 8 of the required divided chamber is opened and closed with a view towards ensuring smooth transfer of the fabric F.

In the foregoing, the present invention is explained by reference to one embodiment, however, it should be noted that the present invention is not limited to such embodiment only, but various changes of design are possible within the scope without departing from the gist of the present invention.

What is claimed is:

1. An apparatus for fluid treatment of a fiber product wherein said fiber product is smoothly circulated in a predetermined direction within said apparatus, which apparatus comprises:

a. a substantially upright cylindrical fiber treatment section having an opening at a side of the lower portion thereof and an opening at a side of the upper portion thereof;

b. a horizontal outer tube connected to said lower opening;

c. a perforated inner tube concentrically provided inside said horizontal outer tube; said perforated inner tube and said horizontal outer tube comprising a fiber residence section;

d. a tube for transferring a fiber product to the terminus of said horizontal outer tube from said opening at the side of the upper portion of said upright cylindrical section;

e. said tube for transferring said fiber product being provided with a treatment fluid jet nozzle for high speed transfer of said fiber product; and f. a high speed reel in the upper portion of said upright cylindrical section;

the circulation of said fiber product being from:

i. the lower portion of said upright cylindrical section to ii. the upper portion of said upright cylindrical section to iii. said transfer tube via said reel to iv. said fiber residence section and v. back to said lower portion of said upright section and wherein an annular space is formed between said horizontal outer tube and said perforated inner tube, said annular space being divided into a desired number of annular chambers via partition rings provided inside said space perpendicular to the horizontal length of said outer tube, each of said annular chambers having a valved outlet connected to a pump where by opening and closing said valved outlets, the position of said fiber in said residence section can be varied to thereby transfer said fiber through said apparatus smoothly, said pump being in liquid flow communication with said treatment fluid jet nozzle.

* * * * *